US007756283B2

(12) United States Patent
Bramsløw

(10) Patent No.: US 7,756,283 B2
(45) Date of Patent: Jul. 13, 2010

(54) SYSTEM AND METHOD FOR MEASURING VENT EFFECTS IN A HEARING AID

(75) Inventor: Lars Bramsløw, Smørum (DK)

(73) Assignee: Oticon A/S, Smorum (DK)

( * ) Notice: Subject to any disclaimer, the term of this patent is extended or adjusted under 35 U.S.C. 154(b) by 1155 days.

(21) Appl. No.: 11/375,103

(22) Filed: Mar. 15, 2006

(65) Prior Publication Data

US 2006/0222195 A1 Oct. 5, 2006

(30) Foreign Application Priority Data

Mar. 29, 2005 (EP) ..... 05102474

(51) Int. Cl.
*H04R 25/00* (2006.01)

(52) U.S. Cl. ..... 381/318; 381/312; 381/317

(58) Field of Classification Search ..... 381/60, 381/312, 314, 316–318
See application file for complete search history.

(56) References Cited

U.S. PATENT DOCUMENTS 6,353,671 B1 3/2002 Kandel et al.
2005/0047620 A1 3/2005 Fretz

FOREIGN PATENT DOCUMENTS

GB 2 311 186 A 9/1997
WO WO-01/06746 A2 1/2001

*Primary Examiner*—Suhan Ni
(74) *Attorney, Agent, or Firm*—Birch, Stewart, Kolasch & Birch, LLP

(57) ABSTRACT

This invention relates to a system (300) for measuring acoustic properties of a vent (126) in a hearing aid. The system (300) comprises: a microphone (202) converting ambient sound pressure to an electric sound signal; a signal processing unit (302) connected to the microphone (202) and generating a processed electric sound signal; and a speaker (204) converting the processed electric sound signal to a processed sound pressure. In addition, the system comprises a determining means, which is adapted to determine the acoustic properties by measuring the acoustic feedback from the speaker 204 to the microphone (202).

16 Claims, 2 Drawing Sheets

SYSTEM AND METHOD FOR MEASURING VENT EFFECTS IN A HEARING AID

FIELD OF INVENTION

This invention relates a system and method for measuring effects of a vent in an ear-mould for retaining a speaker in the ear canal for a behind-the-ear (BTE) hearing aid, a vent in a completely-in-canal (CIC) hearing aid, or a vent in an in-the-ear (ITE) hearing aid. In particular, this invention relates to a system and method for in-situ evaluating the effect of the size of a vent in a hearing aid.

BACKGROUND OF INVENTION

Generally hearing aids are equipped with a vent allowing sound pressure equalisation between ambient and the residual space between the tympanic membrane and ear-mould, ICI, or ITE hearing aid. The vent may also prevent occlusion experienced by the user of the hearing aid, which occlusion is caused by enclosed sound waves conducted via the skull and head tissue to the residual space. The vent ensures that the enclosed pressure changes may be equalised with ambient pressure.

However, the introduction of the vent has a downfall. The acoustic properties of the vent may cause a large leakage of low frequency energy undermining the low frequency gain target of the hearing aid, and, in fact, establish a positive feedback loop between the loud speaker and the microphone. While the leakage of low frequency energy is often compensated by increasing the low frequency gain care should be taken such as to avoid an unstable positive feedback situation.

Hearing aid fitting software uses data tables and/or physical models of the vent for estimating the acoustic properties of the vent during a fitting session with dispenser. However, modelling of the acoustical properties of the vent is very difficult due to an insufficient parametric description of the vent as it has been produced in the actual ITE aid or BTE ear-mould and also the real-ear impedance of the ear and the residual space. Therefore resulting effect of the vent and of interaction between the actual vent and the actual ear is not modelled accurately in the model of an average ear and vent.

In this context the term "dispenser" is to be construed as a person fitting a hearing aid to a user, such as a medical doctor, an audiologist, or any adequately trained person.

Manufacturers of hearing aids store acoustic properties of the vent in the hearing aid. In case the acoustic properties stored in the hearing aid do not correspond to the physical vent this leads to large errors in the prescription and simulation of the hearing aid and hence leads to a poor fitting of the hearing aid to the user. Even if the acoustic properties are measured and stored correctly there is still a large variety in the precise physical shape of the vent, and therefore a variety of possible vent responses.

In addition, the acoustic properties of the vent may be measured by dispenser by means of a Real-Ear-Measurement (REM). This measurement is performed by inserting a microphone in the residual space to measure the sound pressure level at the tympanic member. The dispenser may correlate the results of the REM with the acoustic properties stored in the hearing aid, but the dispenser is not able to change the acoustic properties stored in the hearing aid. Furthermore, the probe causes a change of the residual space and the insertion of the probe as such causes a leakage, which leads to incorrect results.

In view of the problems of introducing a vent in the ear-mould, CIC or ITE it is of utmost importance to design the dimensions of the vent carefully.

Various prior art documents describe feedback cancellation techniques overcoming the above described disadvantages of positive feedback such as caused by the vent. For example, American patent application number US 2001 0002930, which is hereby incorporated in the present specification by reference, discloses a hearing aid comprising feedback cancellation means including means for estimating a physical feedback signal of the hearing aid, and means for modeling a signal processing feedback signal to compensate for the estimated physical feedback signal. The hearing aid further comprises subtracting means, connected to the output of the microphone of the hearing aid and to the output of the feedback cancellation means, for subtracting the signal processing feedback signal from the audio signal to form a compensated audio signal. Hence the feedback cancellation means compensate for feedback introduced by, for example, the vent size of an ear-mould for a BTE hearing aid, a CIC, or a ITE hearing aid. However, the American patent application does not perform an identification of possible causes for the generated positive feedback.

SUMMARY OF THE INVENTION

An object of the present invention is to provide a system and method for measuring the effect of the vent, in particular, measure whether the physical dimensions of the vent are in accordance with specifications.

It is a further object of the present invention to ensure that the acoustic properties of the vent are in accordance with expectations.

A particular advantage of the present invention is the provision of a warning when the acoustic properties of the vent are not as expected, which can then be corrected by the dispenser and hence the fitting of the hearing aid is improved.

A particular feature of the present invention is the provision of a self test of the hearing aid performed at the beginning of a fitting session.

The above objects, advantage and feature together with numerous other objects, advantages and features, which will become evident from below detailed description, are obtained according to a first aspect of the present invention by a system for measuring acoustic properties of a vent in a hearing aid, and comprising: a microphone converting ambient sound pressure to an electric sound signal; a signal processing unit connected to said microphone and adapted to process said electric sound signal and to generate a processed electric sound signal; and a speaker for converting said processed electric sound signal to a processed sound pressure; and wherein said system further comprising determining means adapted to determine said acoustic properties by measuring the acoustic feedback from said speaker to said microphone.

The system according to the first aspect of the present invention is particularly advantageous since the fitting of the hearing aid to the user may be substantially improved, since the actual physical acoustic response of inserting the hearing aid into a user's ear is correlated with the acoustic response expected of the hearing aid. That is, the system may identify causes of reduced operational quality of the hearing during fitting.

The signal processing unit according to the first aspect of the present invention may comprise an input section, a filter section, an amplifier section, and a controller section adapted to control response of the filter section and the amplifier section to an incoming electric signal. The signal processing unit may be implemented by a wide variety of processors know to the person skilled in the art. The controller provides means for adjusting gain of the amplifier section and frequency responses of the filter section according to a user's prescription.

The determining means according to the first aspect of the present invention may comprise a tone generating section adapted to generate an electric tone signal in the electric signal path defined between the microphone and speaker, adapted to pick up the electric tone signal fed back as acoustic feedback from the speaker to the microphone, and adapted to generate a first correlation signal based on comparison between the electric tone signal in the electric signal path defined between the microphone and speaker and the electric tone signal fed back as acoustic feedback from the speaker to the microphone. This approach provides a precise picture of the acoustic properties of the vent when the hearing aid is placed in the user's ear.

In this context the term "a" or "an" is to be construed as one, one or more, i.e. a single element or a plurality of elements. That is, for example the tone generating section may generate one or more electric tone signals.

Alternatively, or additionally, the determining means may further comprise a feedback unit interconnecting output of the amplifier section and input of input section and adapted to generate a second correlation signal based on impulse response of said acoustical feedback path. This approach provide a non-intrusive measurement since it may be inaudible to the user of the hearing aid, and thus the vent and potential leak is included in the acoustical feedback path response.

The system according to the first aspect of the present invention may comprise calculation means connecting with the determining means and adapted to calculate the acoustic properties of vent based on the first and/or second correlation signal. The calculation means may be incorporated in the controller section and/or in a fitting apparatus for fitting the hearing aid with a user.

The system according to the first aspect of the present invention may further comprise transceiver unit interconnecting a fitting apparatus and the controller section, which transceiver unit may be adapted to communicate the first and/or second correlation signal, the calculated acoustic properties of vent, recorded vent data stored in a memory of the hearing aid, or any combination thereof. The transceiver means ensures that the non-calculated data and/or the estimated acoustic properties of the vent are communicated to the fitting apparatus and displayed to the dispenser. The fitting apparatus may comprise warning means adapted to compare the first and/or second correlation signal, and the calculated acoustic properties of vent with the recorded vent data and adapted to provide a warning signal when the acoustic properties of vent and the recorded vent data do not match.

The above objects, advantages and features together with numerous other objects, advantages and features, which will become evident from below detailed description, are obtained according to a second aspect of the present invention by a method for measuring acoustic properties of a vent in a hearing aid, and comprising: measuring a first electric signal indicative of a sound pressure presented by a speaker of said hearing aid, measuring a second electric signal indicative of a said sound pressure recorded by a microphone of said hearing aid, estimating said acoustic properties of vent based on a subtraction between said first and second electric signals by a determining means.

The method according to the second aspect of the present invention may further comprise generating said first electric signal by means of a tone generating section of said hearing aid. By establishing a constant tone signal a well defined estimation of the acoustic properties may be accomplished.

The method according to the second aspect of the present invention may further comprise communicating said acoustic properties of vent, said subtraction between said first and second electric signals, and/or recorded vent data by means of a transceiver unit in said hearing aid.

The method according to the second aspect of the present invention may further comprise correlating said estimated acoustic properties and said recorded vent data and displaying a warning signal when said estimated acoustic properties and said recorded vent data do not match by means of a fitting apparatus.

The method according to the second aspect of the present invention may incorporate any features described with reference to the system according to the first aspect of the present invention.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawing, wherein.

DETAILED DESCRIPTION OF PREFERRED EMBODIMENTS

In the following description of the various embodiments, reference is made to the accompanying figures, which show by way of illustration how the invention may be practiced. It is to be understood that other embodiments may be utilized and structural and functional modifications may be made without departing from the scope of the present invention.

Figure 1:
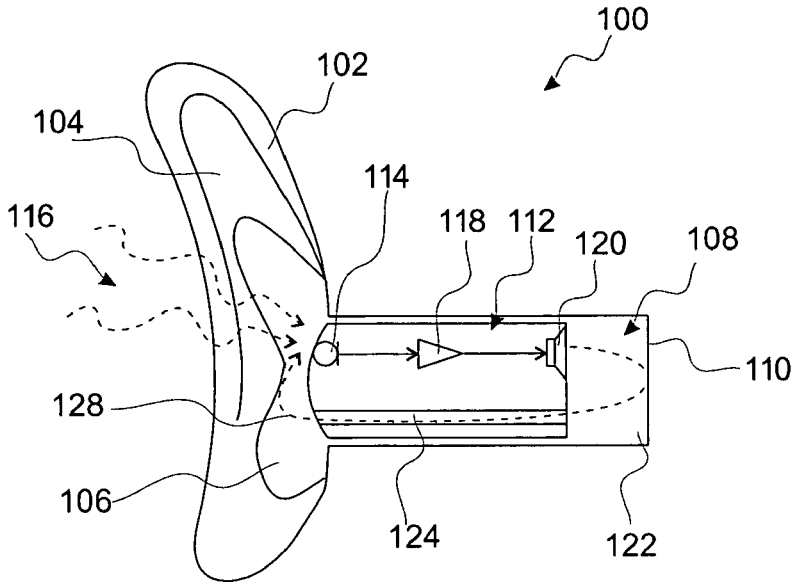
FIG. 1, shows a cross sectional view of an ear with a hearing aid inserted therein.

FIG. 1 shows a cross sectional view of an ear designated in entirety by reference numeral 100. The ear 100 comprises an outer section with helix 102, anthelix and antitragus 104, and conchae 106, and an intermediate section with an ear canal 108 and tympanic member 110.

A CIC hearing aid designated in its entirety by reference numeral 112 is shown in FIG. 1 as positioned in the ear canal 108. The CIC hearing aid 112 comprises a microphone 114 converting an ambient sound, illustrated in FIG. 1 as punctured arrows designated by reference numeral 116, to an electric signal. The electric signal is communicated to signal processing unit 118 being adapted to process the electric signal in accordance with a particular transfer function. The transfer function is prepared as a function of a user's audiogram. Thus the signal processing unit 118 may compensate for the user's hearing disability by amplifying specific frequency bands. The amplified electric signal is communicated to a loud speaker 120, generally referred to as a receiver or telephone within the hearing aid industry. The speaker 120 converts the amplified electric signal to a sound pressure signal, which is communicated to the tympanic membrane 110 through a residual space 122 defined between the speaker end of the CIC hearing aid 112 and the tympanic membrane 110.

The sound pressure signal communicated from the speaker 120 into the residual space 122 creates pressure changes in the residual space 122. These pressure changes may provide an occlusion effect for the user. In order to compensate for this effect the CIC hearing aid 112 is equipped with a vent 124 equalizing the pressure between the residual space 122 and the ambient pressure.

The vent causes some low frequency leakage from the residual space 122 to the ambient. Generally this low frequency leakage is compensated by increasing gain of the lower frequencies in the signal processing unit 118. However, since the vent 124 establishes an acoustic feedback path 128 from the speaker 120 bouncing of the tympanic membrane 100 and through the vent 124 to the microphone particular care should be taken during design of the vent 124 so as to reduce low frequency leakage while maintaining relief of occlusion.

Figure 2:
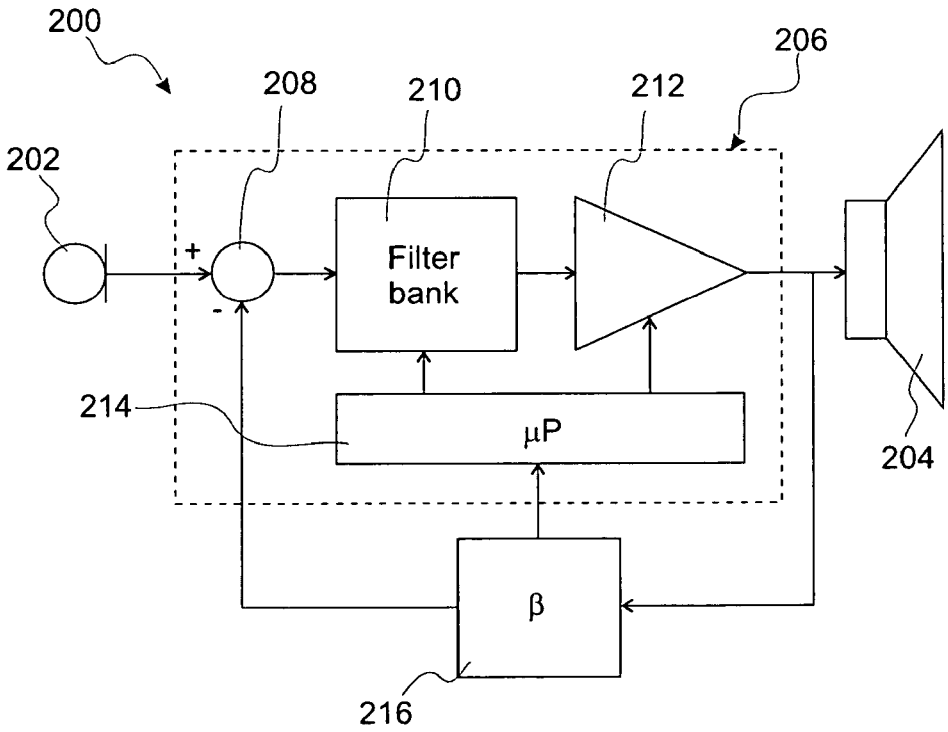
FIG. 2, shows a block diagram of a hearing aid system.

An effective way of reducing the effect of acoustic feedback through the vent 124 is by introducing adaptive feedback cancellation. FIG. 2 shows a block diagram of a hearing aid system 200 such as a BTE, CIC, or ITE hearing aid. The hearing aid system 200 comprises a microphone 202 for converting ambient sound signal to an electric signal, a speaker 204 for converting a processed version of the electric signal to sound signal in the residual space, and a signal processing unit 206 interconnecting the microphone 202 and the speaker 204 and adapted to process the converted ambient sound signal in accordance with a user's hearing disability. That is, the user's sound pressure level response and frequency response.

The signal processing unit 206 comprises a differential input section 208, a filter section 210, an amplifier section 212, and a controller section 214. The differential input section 208 receives on a first input an electric signal from the microphone 202 corresponding to the ambient sound signal, and receives on a second input a feedback signal from an output of a feedback unit 216 having an input connected to the output of the signal processing unit 206. The feedback unit 216 monitors the frequency spectrum of the output of the signal processing unit 206. This monitoring is required in order to cancel potential positive feedback causing the hearing aid to become unstable. In case the feedback unit 216 identifies a narrow band peak in the frequency spectrum, the feedback unit 216 communicates a control signal to the controller section 214, which adapts the signal processing of the received electric signal so as to cancel the feedback element in the electric signal. This may, for example, be done according to the preferred embodiment of the present invention by the controller section 214 and feedback unit 216 operating as described in detail in international patent application nos.: WO 03/034784 and/or WO 01/06746, which are filed by the same applicant, and which international patent applications are incorporated by reference in the present specification.

Figure 3:
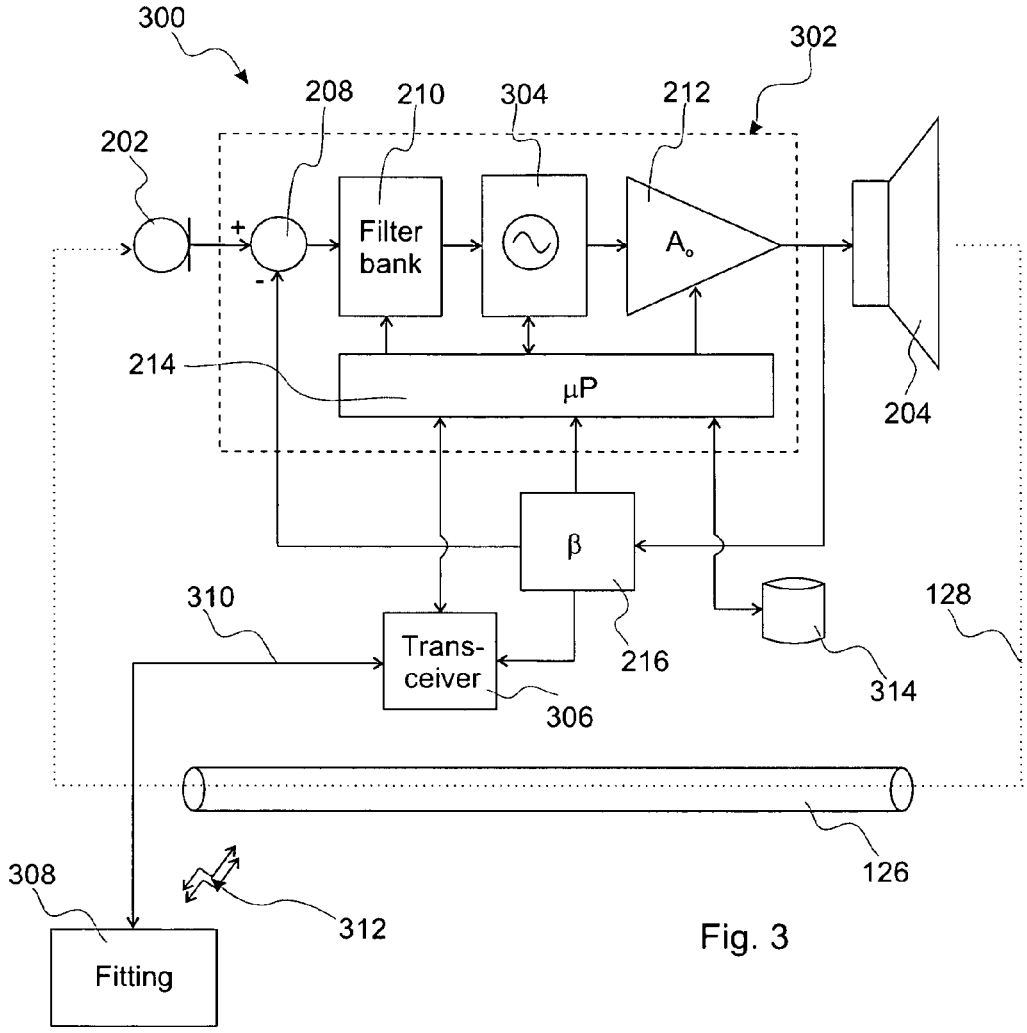
FIG. 3, shows a block diagram of a hearing aid system according to the first embodiment and second embodiment of the present invention.

FIG. 3 shows the system according to the first embodiment of the present invention and designated in entirety by reference numeral 300. Elements which are similar to elements of FIG. 2 are referred to by the same reference numerals.

The system 300 differs from the system 200 described with reference to FIG. 2 by a signal processing unit 302, which in addition to the differential input section 208, the filter section 210, the amplifier section 212 and the controller section 214 comprises a tone generating section 304 for generating a clean sinusoidal tone.

During a fitting session the tone generating section 304 generates one or more sinusoidal electric signals to be forwarded to the speaker 204. The speaker 204 converts the electric signals into a sound signal, which follows the acoustic feedback path 128 through the vent 124 back to the microphone 202 converting the fed back sound signal back into an electric signal input to the signal processing unit 302. The tone generating section 304 senses the electric signals output from the filter section 210 and correlates between the one or more sinusoidal electric signals and the fed back electric signal and communicates a correlation signal to the controller section 214. The controller section 214 determines on the basis of the correlation signal the in-situ acoustic properties of the vent 126. The in-situ acoustic properties are forwarded to a transceiver unit 306, which communicates the in-situ acoustic properties to an external fitting apparatus 308 used by the dispenser. The transceiver unit 306 may communicate with the fitting apparatus 308 either through a wired connection 310 or a wireless connection 312 or a combination thereof.

It is to be understood that the tone generating section 304 may be inserted at any position in the electrical signal path from the microphone 202 to the speaker 204.

In an alternative embodiment the controller section 214 communicates the correlation signal without processing to the fitting apparatus 308, which on the basis of this data determines the acoustic properties of the vent 126.

In a further or alternative embodiment of the present invention the system 300 utilises the fact that the feedback unit 216 continuously monitors the acoustic feedback as described above with reference to international patent application nos.: WO 03/034784 or WO 01/06746. During a fitting session the feedback unit 216 measures the acoustic feedback and communicates this data to the controller section 214 of the signal processing unit 302, which through the transceiver unit 306 initiates a transmission of the data to the fitting apparatus 308. Alternatively, the feedback unit 216 communicates directly with the transceiver unit 306.

The fitting apparatus 308 receives the data from the transceiver 306 and initiates a modelling of the vent 126 so as to determine the in-situ acoustic properties determined by the physical dimensions of the vent 126 in the actual fitted situation (in-situ).

The advantage of utilising the tone generating section 304 is that it provides a high precision estimation of the acoustic properties of the vent 126 in operating situation (in-situ) through a broad bandwidth. However, this measuring process or method generates an audible sound.

The advantage of utilising the feedback unit 216 is that it provides a very fast and simple means for determining the acoustic properties of the vent 126 in operating situation. Besides it is in-audible to the user of the hearing aid. However, this measuring process or method is less precise in the low frequency area.

The fitting software operating in the fitting apparatus 308 uses the gathered data to estimate and store the relevant acoustic properties of the vent 126. These data are subsequently used in the prescription of the hearing aid settings, calculation of fitting controls, and of simulation graphs.

A number of actions may be relevant for the dispenser. Firstly, upon completion of the estimation of the acoustic properties of the vent 126, the dispenser is presented with the vent 126 properties and the dispenser is requested to confirm these. If the acoustic properties of the vent 126 differ from the expected acoustic properties of the vent 126 stored in a memory unit 314 of the hearing aid a warning is issued. Secondly, the dispenser is informed when problems with the feedback or vent responses occur and the dispenser is informed about this and about possible actions e.g. reduction of the diameter of the vent 126 or changing the length of the vent 126 or the dispenser may manually lower gain of the hearing aid.

If the dispenser desires to increase credibility of the estimation of the acoustic properties of the vent 126, the dispenser may perform several insertions of the ear-plug or CIC or ITE hearing aid.

The invention claimed is:

1. A system for measuring acoustic properties of a vent in a hearing aid, comprising:

a microphone converting ambient sound pressure to an electric sound signal;

a signal processing unit connected to said microphone and configured to process said electric sound signal and to generate a processed electric sound signal, the signal processing unit including an input section, a filter section, an amplifier section, and a controller section configured to control a response of said filter section and said amplifier section to an incoming electric signal;

a speaker for converting said processed electric sound signal to a processed sound pressure;

a determining unit configured to determine said acoustic properties by measuring acoustic feedback from said speaker to said microphone; and a transceiver unit interconnecting a fitting apparatus and said controller section.

2. A system according to claim 1, wherein said determining unit comprises:

a tone generating section configured to generate one or more electric tone signals in the electric signal path defined between said microphone and said speaker, configured to pick up said one or more electric tone signals fed back as acoustic feedback from said speaker to said microphone, and configured to generate a first correlation signal based on comparison between said one or more electric tone signals in the electric signal path defined between said microphone and said speaker and said one or more electric tone signals fed back as acoustic feedback from said speaker to said microphone, and the transceiver unit is configured to communicate said first correlation signal to the fitting apparatus.

3. A system according to claim 2, further comprising:

a calculation unit connecting with said determining unit and configured to calculate said acoustic properties of the vent based on said first correlation signal.

4. A system according to claim 3, wherein said calculation unit is incorporated in said controller section and/or in the fitting apparatus.

5. A system according to claim 2, wherein the transceiver unit is configured to communicate recorded vent data, stored in a memory connecting to said controller section, to the fitting apparatus, and the fitting apparatus includes a warning unit configured to compare said acoustic properties of the vent and said first correlation signal with said recorded vent data, and configured to provide a warning signal when said acoustic properties of vent and said recorded vent data do not match.

6. A system according to claim 1, wherein said determining unit comprises:

a feedback unit interconnecting output of said amplifier section and input of said input section, the feedback unit configured to generate a second correlation signal based on impulse response of acoustic feedback path from said speaker to said microphone, and the transceiver unit is configured to communicate said second correlation signal to the fitting apparatus.

7. A system according to claim 6, further comprising:

a calculation unit connecting with said determining unit and configured to calculate said acoustic properties of the vent based on said second correlation signal.

8. A system according to claim 6, wherein the transceiver unit is configured to communicate recorded vent data, stored in a memory connecting to said controller section, to the fitting apparatus, and the fitting apparatus includes a warning unit configured to compare said acoustic properties of the vent and said second correlation signal with said recorded vent data, and configured to provide a warning signal when said acoustic properties of vent and said recorded vent data do not match.

9. A system according to claim 1, wherein the transceiver unit is configured to communicate recorded vent data, stored in a memory connecting to said controller section, to the fitting apparatus.

10. A system according to claim 9, wherein said fitting apparatus comprises:

a warning unit configured to compare said acoustic properties of the vent with said recorded vent data, and configured to provide a warning signal when said acoustic properties of vent and said recorded vent data do not match.

11. A system according to claim 1, wherein the transceiver unit is configured to communicate said acoustic properties of the vent to the fitting apparatus.

12. A method for measuring acoustic properties of a vent in a hearing aid, comprising:

measuring a first electric signal indicative of a sound pressure presented by a speaker of said hearing aid;

measuring a second electric signal indicative of a said sound pressure recorded by a microphone of said hearing aid;

estimating said acoustic properties of vent based on a subtraction between said first and second electric signals by a determining unit; and communicating said estimated acoustic properties of the vent to a fitting apparatus by means of a transceiver unit interconnecting the fitting apparatus and a controller section of the hearing aid.

13. A method according to claim 12 further comprising generating said first electric signal by means of a tone generating section of said hearing aid.

14. A method according to any of claims 12 to 13, further comprising:

communicating said subtraction between said first and second electric signals, by means of the transceiver unit in said hearing aid.

15. A method according to claim 12, further comprising:

communicating recorded vent data, stored in a memory connecting to the controller section of the hearing aid, by means of the transceiver unit in said hearing aid.

16. A method according to claim 15, further comprising:

correlating said estimated acoustic properties and said recorded vent data and displaying a warning signal when said estimated acoustic properties and said recorded vent data do not match by means of the fitting apparatus.

* * * * *